US010895169B2

(12) United States Patent
Kuwamura et al.

(10) Patent No.: US 10,895,169 B2
(45) Date of Patent: Jan. 19, 2021

(54) EXHAUST CASING, AND STEAM TURBINE PROVIDED WITH SAME

(71) Applicant: MITSUBISHI HITACHI POWER SYSTEMS, LTD., Yokohama (JP)

(72) Inventors: Yoshihiro Kuwamura, Tokyo (JP); Kazuyuki Matsumoto, Tokyo (JP)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 16/483,257

(22) PCT Filed: Feb. 14, 2018

(86) PCT No.: PCT/JP2018/005088
§ 371 (c)(1),
(2) Date: Aug. 2, 2019

(87) PCT Pub. No.: WO2018/151158
PCT Pub. Date: Aug. 23, 2018

(65) Prior Publication Data

US 2019/0353053 A1 Nov. 21, 2019

(30) Foreign Application Priority Data

Feb. 14, 2017 (JP) ..... 2017-024902

(51) Int. Cl.
*F01D 25/24* (2006.01)
*F01D 25/30* (2006.01)
(Continued)

(52) U.S. Cl.
CPC ..... *F01D 25/24* (2013.01); *F01D 1/02* (2013.01); *F01D 25/30* (2013.01); *F01D 25/162* (2013.01)

(58) Field of Classification Search
CPC . F01D 25/24; F01D 1/02; F01D 25/30; F01D 25/162
(Continued)

(56) References Cited

U.S. PATENT DOCUMENTS 5,588,799 A * 12/1996 Kreitmeier ..... F01D 25/30 415/207
6,203,274 B1 3/2001 Kikuchi et al.
(Continued)

FOREIGN PATENT DOCUMENTS

JP S59-060009 A 4/1984
JP S62-041904 A 2/1987
(Continued)

OTHER PUBLICATIONS

International Search Report dated Apr. 24, 2018, issued in counterpart application No. PCT/JP2018/005088, with English translation. (2 pages).
(Continued)

*Primary Examiner* — Hoang M Nguyen
(74) *Attorney, Agent, or Firm* — Westerman, Hattori, Daniels & Adrian, LLP

(57) ABSTRACT

An exhaust casing is provided with an outer casing which communicates with a diffuser. The outer casing has a downstream side end plate defining an edge on an axially downstream side of an exhaust space, and an inclined plate connected to the downstream side end plate. The inclined plate gradually widens toward an axially upstream side toward a radially outer side. An angle of an inclined inner surface of the inclined plate with respect to a tangential line at an end on the radially outer side of an inner peripheral surface of an outer diffuser, which is an upstream side angle
(Continued)

of the axially upstream side on the basis of the tangential line, is greater than a downstream side angle of the axially downstream side.

8 Claims, 12 Drawing Sheets

(51) Int. Cl.
*F01D 1/02* (2006.01)
*F01D 25/16* (2006.01)

(58) Field of Classification Search
USPC ..... 60/687, 694; 415/208.1, 208.2, 210.1, 415/211.2, 148, 150
See application file for complete search history.

(56) References Cited

U.S. PATENT DOCUMENTS

| | | | | |
|---|---|---|---|---|
| 6,261,055 | B1 * | 7/2001 | Owczarek | F01D 1/02 415/148 |
| 6,267,556 | B1 | 7/2001 | Kikuchi et al. | |
| 6,419,448 | B1 * | 7/2002 | Owczarek | F01D 1/02 415/207 |
| 6,533,546 | B2 * | 3/2003 | Kreitmeier | F01D 9/02 415/211.2 |
| 2002/0127100 | A1 | 9/2002 | Kreitmeier | |
| 2006/0222489 | A1 | 10/2006 | Mizumi et al. | |
| 2011/0162369 | A1 | 7/2011 | Myoren et al. | |
| 2012/0183397 | A1 | 7/2012 | Mizumi et al. | |
| 2014/0157778 | A1 | 6/2014 | Ponnuraj et al. | |
| 2017/0198608 | A1 * | 7/2017 | Ono | F01D 25/30 |

FOREIGN PATENT DOCUMENTS

| | | | |
|---|---|---|---|
| JP | S63-080003 | A | 4/1988 |
| JP | H01-178706 | A | 7/1989 |
| JP | H02-119602 | A | 5/1990 |
| JP | H03-107505 | A | 5/1991 |
| JP | H04-041907 | A | 2/1992 |
| JP | H08-260904 | A | 10/1996 |
| JP | H09-264106 | A | 10/1997 |
| JP | H11-013415 | A | 1/1999 |
| JP | H11-200814 | A | 7/1999 |
| JP | 2600164 | Y2 | 10/1999 |
| JP | H11-303607 | A | 11/1999 |
| JP | H11-303608 | A | 11/1999 |
| JP | 2000-161012 | A | 6/2000 |
| JP | 2000-274207 | A | 10/2000 |
| JP | 2002-054404 | A | 2/2002 |
| JP | 2003-027905 | A | 1/2003 |
| JP | 2006-083801 | A | 3/2006 |
| JP | 2006-283589 | A | 10/2006 |
| JP | 2006-329148 | A | 12/2006 |
| JP | 2007-064190 | A | 3/2007 |
| JP | 2007-224888 | A | 9/2007 |
| JP | 2007-255218 | A | 10/2007 |
| JP | 2007-291855 | A | 11/2007 |
| JP | 2007-303324 | A | 11/2007 |
| JP | 2009-036118 | A | 2/2009 |
| JP | 2009-103099 | A | 5/2009 |
| JP | 2011-069308 | A | 4/2011 |
| JP | 2011-140900 | A | 7/2011 |
| JP | 2011-220125 | A | 11/2011 |
| JP | 2012-067604 | A | 4/2012 |
| JP | 2012-122390 | A | 6/2012 |
| JP | 2012-145081 | A | 8/2012 |
| JP | 2014-005813 | A | 1/2014 |
| JP | 2014-040803 | A | 3/2014 |
| JP | 2014-125963 | A | 7/2014 |
| JP | 2014-137049 | A | 7/2014 |
| JP | 2015-017520 | A | 1/2015 |
| JP | 2015-098824 | A | 5/2015 |

OTHER PUBLICATIONS

Written Opinion dated Apr. 24, 2018, issued in counterpart application No. PCT/JP2018/005088, with English translation. (7 pages).

* cited by examiner

EXHAUST CASING, AND STEAM TURBINE PROVIDED WITH SAME

TECHNICAL FIELD

The present invention relates to an exhaust casing, and a steam turbine provided with the same.

Priority is claimed on Japanese Patent Application No. 2017-024902, filed Feb. 14, 2017, the content of which is incorporated herein by reference.

BACKGROUND ART

A steam turbine is provided with an exhaust casing that guides the steam flowing out of a last rotor blade row of a turbine rotor to the outside. The exhaust casing has a diffuser and an outer casing. The diffuser has an annular shape with respect to an axis, and forms a diffuser space which is gradually directed radially outward toward an axially downstream side. The diffuser has an outer diffuser (or a steam guide or a flow guide) which defines an edge on a radially outer side of the diffuser space, and an inner diffuser (or a bearing cone) which defines an edge on a radially inner side of the diffuser space. The steam flowing out of the last rotor blade row of the turbine rotor flows into the diffuser space. The outer casing communicates with the diffuser, and the outer circumference of the diffuser widens in a circumferential direction with respect to the axis to form an exhaust space for guiding the steam having flowed in from the diffuser space to the outside.

For example, the outer casing in the steam turbine described in Patent Literature 1 described below has a downstream side end plate that defines an edge on an axially downstream side of the exhaust space, and a side peripheral plate that defines an edge on a radially outer side of the exhaust space. The downstream side end plate extends radially outward from the end on the radially outer side of the inner diffuser, perpendicularly to the axis. The side peripheral plate is connected to the downstream side end plate and widens in the circumferential direction about the axis.

CITATION LIST

Patent Literature

[Patent Literature 1]

Japanese Unexamined Patent Application, First Publication No. 2006-329148

SUMMARY OF INVENTION

Technical Problem

In the exhaust casing, pressure recovery of the steam flowing out of the last rotor blade row is achieved. As the amount of pressure recovery becomes larger, the pressure of the steam immediately after flowing out of the last rotor blade row decreases, and turbine efficiency is improved. Therefore, it is desirable to reduce the pressure loss of the steam flowing in the exhaust casing to increase the amount of pressure recovery.

Thus, an object of the present invention is to provide an exhaust casing capable of reducing the pressure loss of steam to increase the amount of pressure recovery, and a steam turbine provided with the exhaust casing.

Solution to Problem

According to an aspect of the present invention for achieving the aforementioned object, there is provided an exhaust casing which is configured to guide steam flowing out of a last rotor blade row of a steam turbine rotor rotating about an axis to an outside, the exhaust casing including a diffuser and an outer casing. The steam flowing out of the last rotor blade row flows into the diffuser, and the diffuser has an annular shape with respect to the axis, and forms a diffuser space directed gradually to a radially outer side with respect to the axis toward an axially downstream side. The outer casing has an exhaust port opening toward the radially outer side, communicates with the diffuser, and widens an outer circumference of the diffuser in a circumferential direction with respect to the axis to form an exhaust space which is configured to guide the steam flowing in from the diffuser space to the exhaust port.

The diffuser has an outer diffuser and an inner diffuser. The outer diffuser has an annular cross section perpendicular to the axis and gradually widens to the radially outward toward the axially downstream side to define an edge on the radially outer side of the diffuser space. The inner diffuser has an annular cross section perpendicular to the axis, and gradually widens to the radially outward toward the axially downstream side to define an edge on a radially inner side of the diffuser space with respect to the axis.

The outer casing has a downstream side end plate and an inclined plate. The downstream side end plate widens to the radially outward from the edge on the radially outer side of the inner diffuser to define an edge on the axially downstream side of the exhaust space. The inclined plate is disposed on the side radially outward from the downstream side end plate in a region on a side opposite to the exhaust port on the basis of the axis, and gradually widens to and axially upstream side toward the radially outer side to define a part of the edge on the radially outer side of the exhaust space. The side peripheral plate is connected to the downstream side end plate and the inclined plate, and widens in the circumferential direction about the axis to define another part of the edge on the radially outer side of the exhaust space.

In the inclined plate, an edge on the axially upstream side at a position diametrically opposite to the exhaust port on the basis of the axis is located on the axially upstream side, on the basis of a virtual plane which widens from an end on the rad ally outer side of the outer diffuser and is parallel to the downstream side end plate. The angle of an inclined inner surface defining the exhaust space with the inclined plate with respect to a tangential line at the end on the radially outer side of the inner peripheral surface of the outer diffuser, which is an upstream side angle on the axially upstream side on the basis of the tangential line in the exhaust space, is greater than an angle of the inclined inner surface with respect to the tangential line, which is a downstream side angle on the axially downstream side on the basis of the tangential line in the exhaust space.

In a region on the side opposite to the exhaust port on the basis of the axis in the exhaust space, a flowing direction of the steam having flowed into the exhaust space along the inner peripheral surface of the outer diffuser is substantially a tangential direction in which the tangential line at the end on the radially outer side of the inner peripheral surface of the outer diffuser extends. In the exhaust casing, the upstream side angle is greater than the downstream side angle. For this reason, in the exhaust casing, even if steam flowing substantially in the tangential direction collides with the inclined inner surface of the inclined plate in the region on the side opposite to the exhaust port, the amount of steam flowing to the axially upstream side along the inclined inner surface becomes greater than the amount of steam flowing to the axially downstream side along the inclined inner surface. For this reason, in the exhaust casing, the amount of steam flowing backward in the exhaust casing can be reduced.

Therefore, in the exhaust casing, the pressure loss of steam in the exhaust casing becomes small, and the amount of pressure recovery of the steam flowing out of the last rotor blade row can be increased.

Incidentally, in the region on the side opposite to the exhaust port, the flowing direction of the steam having flowed into the exhaust space along the inner peripheral surface of the outer diffuser does not exactly become the tangential direction in which the tangential line at the end on the radially outer side of the inner peripheral surface of the outer diffuser extends. The steam having flowed into the exhaust space along the inner peripheral surface of the outer diffuser flows slightly toward the axially upstream side, while flowing in the tangential direction due to the presence of the downstream side end plate. That is, the flowing direction of the steam having flowed into the exhaust space along the inner peripheral surface of the outer diffuser includes a slight directional component to the axially upstream side in addition to the component in the tangential direction.

Therefore, if the edge on the axially upstream side at the position diametrically opposite to the exhaust port on the basis of the axis in the inclined plate is located on the tangential line, the steam having flowed into the exhaust space along the inner peripheral surface of the outer diffuser collides with the edge on the inclined plate. Therefore, the edge on the axially upstream side at the position diametrically opposite to the exhaust port on the basis of the axis in the inclined plate is located on the axially upstream side, on the basis of a virtual plane that widens from the end on the radially outer side of the inner diffuser and is parallel to the downstream side end plate so that the steam having flowed into the exhaust space along the inner peripheral surface of the outer diffuser collides with the inclined inner surface of the inclined plate.

Here, in the exhaust casing, the upstream side angle may be 100° or more.

Further, in any one of the aforementioned exhaust casings, the edge on the axially upstream side of the inclined plate may be gradually displaced to the axially downstream side from the diametrically opposite position toward the exhaust port in the circumferential direction with respect to the axis, and an length of the inclined plate may gradually shorten from the diametrically opposite position toward the exhaust port in the circumferential direction.

In a flowing directional component of the steam having flowed into the exhaust space along the inner peripheral surface of the outer diffuser from the position diametrically opposite to the exhaust port on the basis of the axis in the exhaust space toward the exhaust port in the circumferential direction, a directional component on the side closer to the exhaust port in the circumferential direction with respect to the axis is greater than a component in the tangential direction in which the tangential line at the end on the radially outer side of the inner peripheral surface of the outer diffuser extends. This is because steam containing a large circumferential component flows into the region on the side of the exhaust port in the circumferential direction with respect to the position diametrically opposite to the exhaust port from the side of the position diametrically opposite to the exhaust port. In this way, if a directional component on the side closer to the exhaust port in the circumferential direction among the flowing directional components of the steam having flowed into the exhaust space along the inner peripheral surface of the outer diffuser increases, even if the steam collides with the side peripheral plate, the flow rate of the steam flowing backward decreases.

For this reason, the significance of the presence of the inclined plate gradually decreases from the position diametrically opposite to the exhaust port in the exhaust space toward the exhaust port in the circumferential direction. Moreover, when the inclined plate is provided, since a flow passage cross-sectional area in the exhaust casing decreases, a pressure loss of steam in the region on the exhaust port side increases. Therefore, as in the exhaust casing, the axial length of the inclined plate may be gradually shortened from the diametrically opposite position toward the exhaust port in the circumferential direction.

In the aforementioned exhaust casings, the inclined plate may not exist on a side of the exhaust port with respect to the axis.

On the side of the exhaust port with respect to the axis in the exhaust space, in the flowing directional components of the steam having flowed into the exhaust space along the inner peripheral surface of the outer diffuser, a directional component on the side closer to the exhaust port in the circumferential direction with respect to the axis is greater than the component in the tangential direction in which the tangential line at the end on the radially outer side of the inner peripheral surface of the outer diffuser extends. For this reason, in the region on the exhaust port side, there is substantially no back flow of steam as in the region on the side opposite to the exhaust port. Therefore, it is preferable that the inclined plate does not exist on the side of the exhaust port with respect to the axis from the viewpoint of pressure loss or the like as in the exhaust casing.

In any one of the aforementioned exhaust casings, the outer casing may have a downstream side connection plate which connects the edge on the radially outer side of the downstream side end plate and the edge on the axially downstream side of the inclined plate, and the downstream side connection plate may have a curved surface which gradually bends to the axially upstream side from the downstream side inner surface defining the exhaust space with the downstream side end plate toward the radially outer side, and smoothly connects the downstream side inner surface and the inclined inner surface of the inclined plate.

In the exhaust casing, by interposing the downstream side connection plate between the downstream side end plate and the inclined plate, the angle between the downstream side end plate and the inclined plate is eliminated. Therefore, in the exhaust casing, the circulation region of the steam in the vicinity of the edge on the radially outer side of the downstream side end plate decreases, or the circulation region of the steam is eliminated.

In any one of the aforementioned exhaust casings, the outer casing may have an upstream side end plate which faces the downstream side end plate in the axial direction to define the edge on the axially upstream side of the exhaust space, and the edge on the axially upstream side at the diametrically opposite position of the inclined plate may be connected to the edge on the radially outer side of the upstream side end plate.

As in the exhaust casings described above, in the exhaust casing, the flowing direction of the steam having flowed into the exhaust space along the inner peripheral surface of the outer diffuser in the region on the side opposite to the exhaust port in the exhaust space also becomes a substantially tangential direction in which the tangential line at the end on the radially outer side of the inner peripheral surface of the outer diffuser extends. When the steam collides with the inclined inner surface of the inclined plate, most of the steam flows to the axially upstream side along the inclined inner surface. In the inclined plate of the exhaust casing, the edge on the axially upstream side at the diametrically opposite position extends to the edge on the radially outer side of the upstream side end plate, and the axial length at the diametrically opposite position of the inclined plate is long. For this reason, in the exhaust casing, after the steam collides with the inclined inner surface of the inclined plate, the flow of the steam flowing to the axially upstream side along the inclined inner surface is stabilized.

In any one of the aforementioned exhaust casings, the outer casing may have an upstream side end plate which faces the downstream side end plate in the axial direction to define the edge on the axially upstream side of the exhaust space, and an upstream side connection plate which connects the edge on the axially upstream side of the inclined plate and the edge on the radially outer side of the upstream side end plate, and the upstream side connection plate may have a curved surface which gradually bends radially inward from the inclined inner surface of the inclined plate toward the axially upstream side, and smoothly connects the inclined inner surface and the upstream side inner surface defining the exhaust space with the upstream side end plate.

In the exhaust casing, by interposing the upstream side connection plate between the inclined plate and the upstream side end plate, the angle between the inclined plate and the upstream side end plate is eliminated. For this reason, in the exhaust casing, the circulation region of the steam in the vicinity of the edge on the radially outer side of the upstream side end plate decreases, or the circulation region of the steam is eliminated.

According to an aspect of the invention for achieving the above object, there is provided a steam turbine including any one of the aforementioned exhaust casings; the steam turbine rotor; a cylindrical inner casing disposed on an outer peripheral side of the steam turbine rotor; and a stator blade row disposed on an inner peripheral side of the inner casing, and having an end on the radially outer side attached to the inner casing.

Advantageous Effects of Invention

In the exhaust casing according to an aspect of the present invention, it is possible to increase the amount of pressure recovery by reducing the pressure loss of steam.

DESCRIPTION OF EMBODIMENTS

Hereinafter, various embodiments of the steam turbine provided with the exhaust casing according to the present invention, and various modified examples of the exhaust casing will be described in detail with reference to the drawings.

First Embodiment

A first embodiment of the steam turbine according to the present invention will be described with reference to FIGS. 1 to 6.

Figure 1:
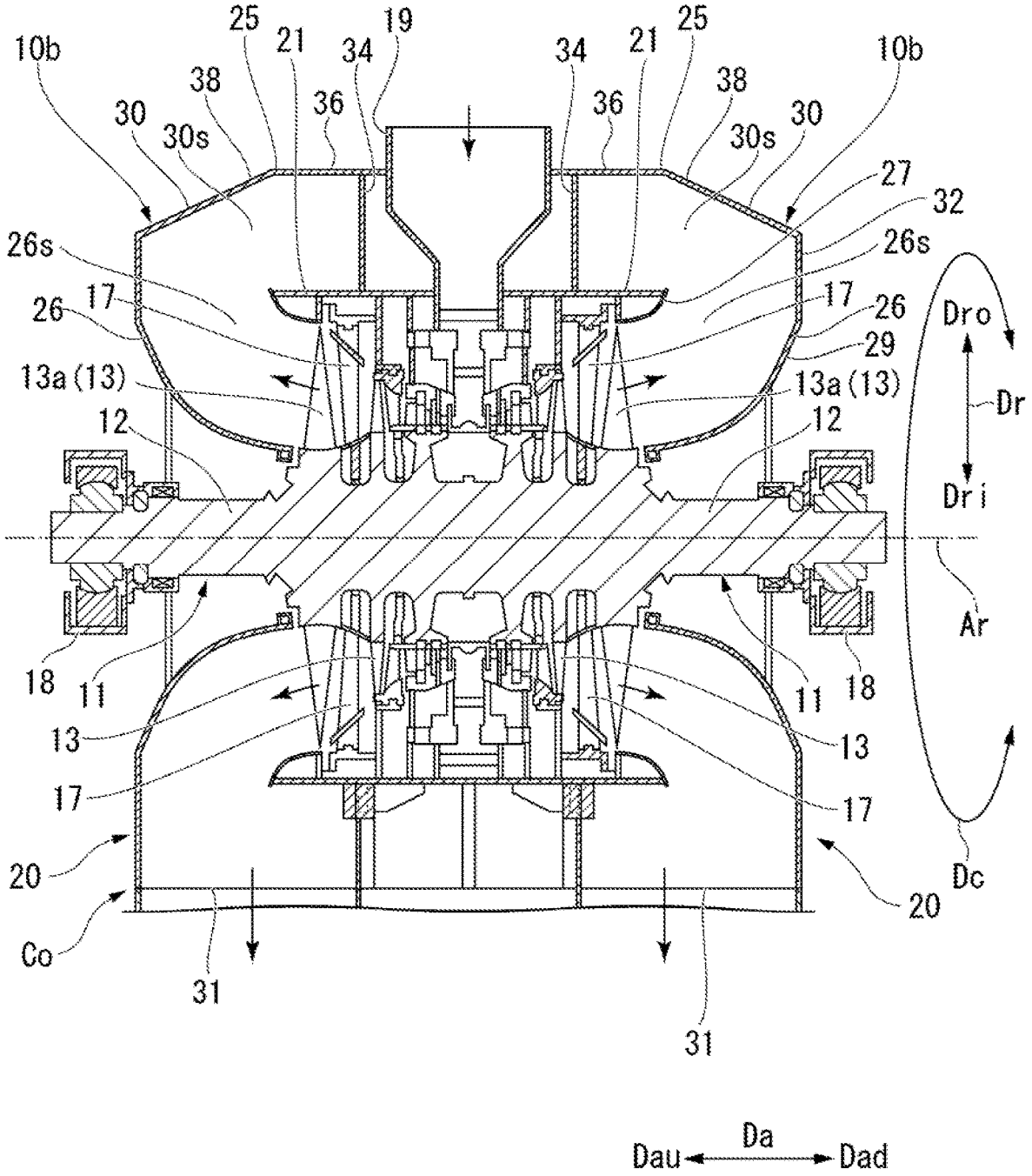
FIG. 1 is an overall cross-sectional view of a steam turbine according to a first embodiment of the present invention.
Figure 4:
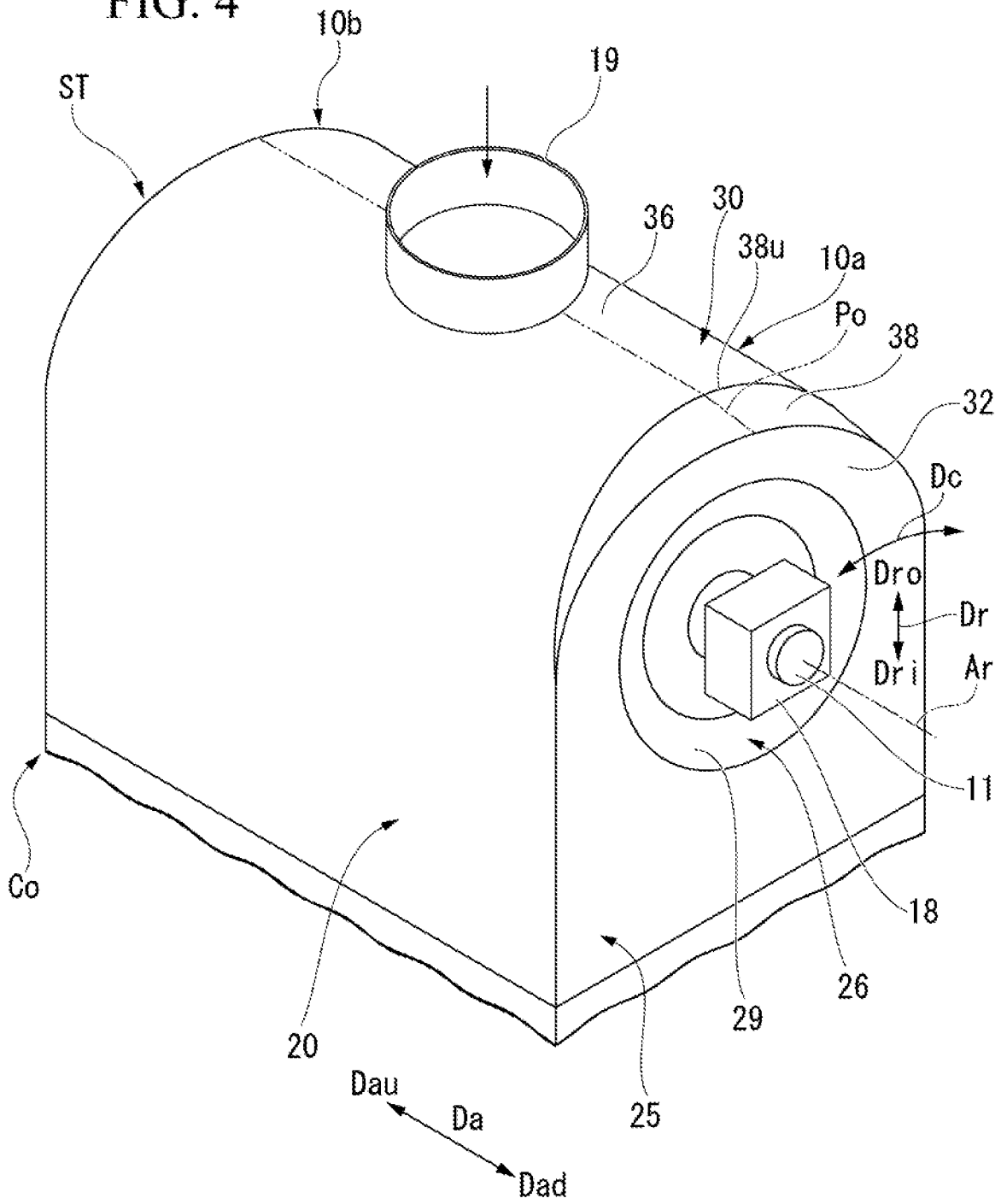
FIG. 4 is an overall perspective view of the steam turbine according to the first embodiment of the present invention.

A steam turbine ST of the first embodiment is a branched exhaust type steam turbine. Therefore, as shown in FIGS. 1 and 4, the steam turbine ST is provided with a first steam turbine unit 10*a* and a second steam turbine unit 10*b*. Each of the first steam turbine unit 10*a* and the second steam turbine unit 10*b* is provided with a turbine rotor 11 which rotates about an axis Ar, a casing 20 which covers the turbine rotor 11, a plurality of stator blade rows 17 fixed to the casing 20, and a steam inflow pipe 19. Further, hereinafter, the circumferential direction centered on the axis Ar is simply referred to as a circumferential direction Dc, and a direction perpendicular to the axis Ar is referred to as a radial direction Dr. Further, a side of the axis Ar in the radial direction Dr is referred to as a radially inner side Dri, and a side opposite thereto is referred to as a radially outer side Dro.

The first steam turbine unit 10*a* and the second steam turbine unit 10*b* share the steam inflow pipe 19. In the first steam turbine unit 10*a*, components other than the steam inflow pipe 19 are disposed on one side in the axial direction Da on the basis of the steam inflow pipe 19. Further, in the second steam turbine unit 10*b*, components other than the steam inflow pipe 19 are disposed on the other side in the axial direction Da on the basis of the steam inflow pipe 19. In each of the steam turbine units 10*a* and 10*b*, the side of the steam inflow pipe 19 in the axial direction Da described above is referred to as an axially upstream side Dau, and an opposite side thereof is referred to as an axially downstream side Dad.

The configuration of the first steam turbine unit 10*a* and the configuration of the second steam turbine unit 10*b* are basically the same. Therefore, the first steam turbine unit 10*a* will be mainly described below.

The turbine rotor 11 has a rotor shaft 12 extending in the axial direction Da about the axis Ar, and a plurality of rotor blade rows 13 attached to the rotor shaft 12. The turbine rotor 11 is supported by a bearing 18 to be rotatable about the axis Ar. The plurality of rotor blade rows 13 are arranged in the axial direction Da. Each rotor blade row 13 is constituted by a plurality of rotor blades arranged in the circumferential direction Dc. The turbine rotor 11 of the first steam turbine unit 10*a* and the turbine rotor 11 of the second steam turbine unit 10*b* are located on the same axis Ar, connected to each other, and integrally rotate about the axis Ar.

The casing 20 has an inner casing 21 and an exhaust casing 25. The inner casing 21 forms a substantially conical space about the axis Ar. The plurality of rotor blade rows 13 of the turbine rotor 11 are disposed in the conical space. The plurality of stator blade rows 17 are disposed in the conical space in line with the axial direction Da. Each of the plurality of stator blade rows 17 is disposed on the axially upstream side Dau of any one rotor blade row 13 among the plurality of rotor blade rows 13. The plurality of stator blade rows 17 are fixed to the inner casing 21.

Figure 2:
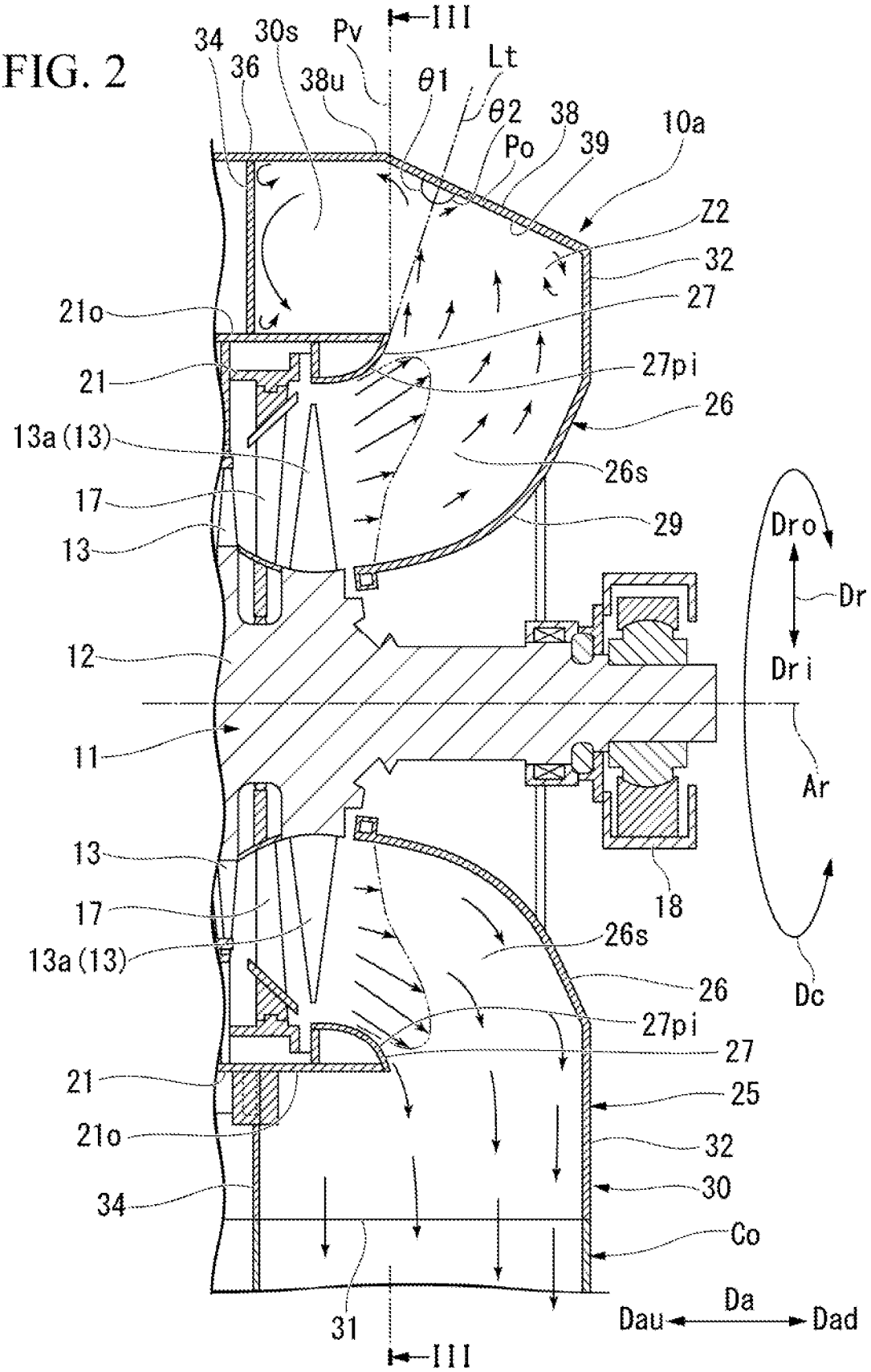
FIG. 2 is a cross-sectional view of main parts of the steam turbine according to the first embodiment of the present invention.
Figure 3:
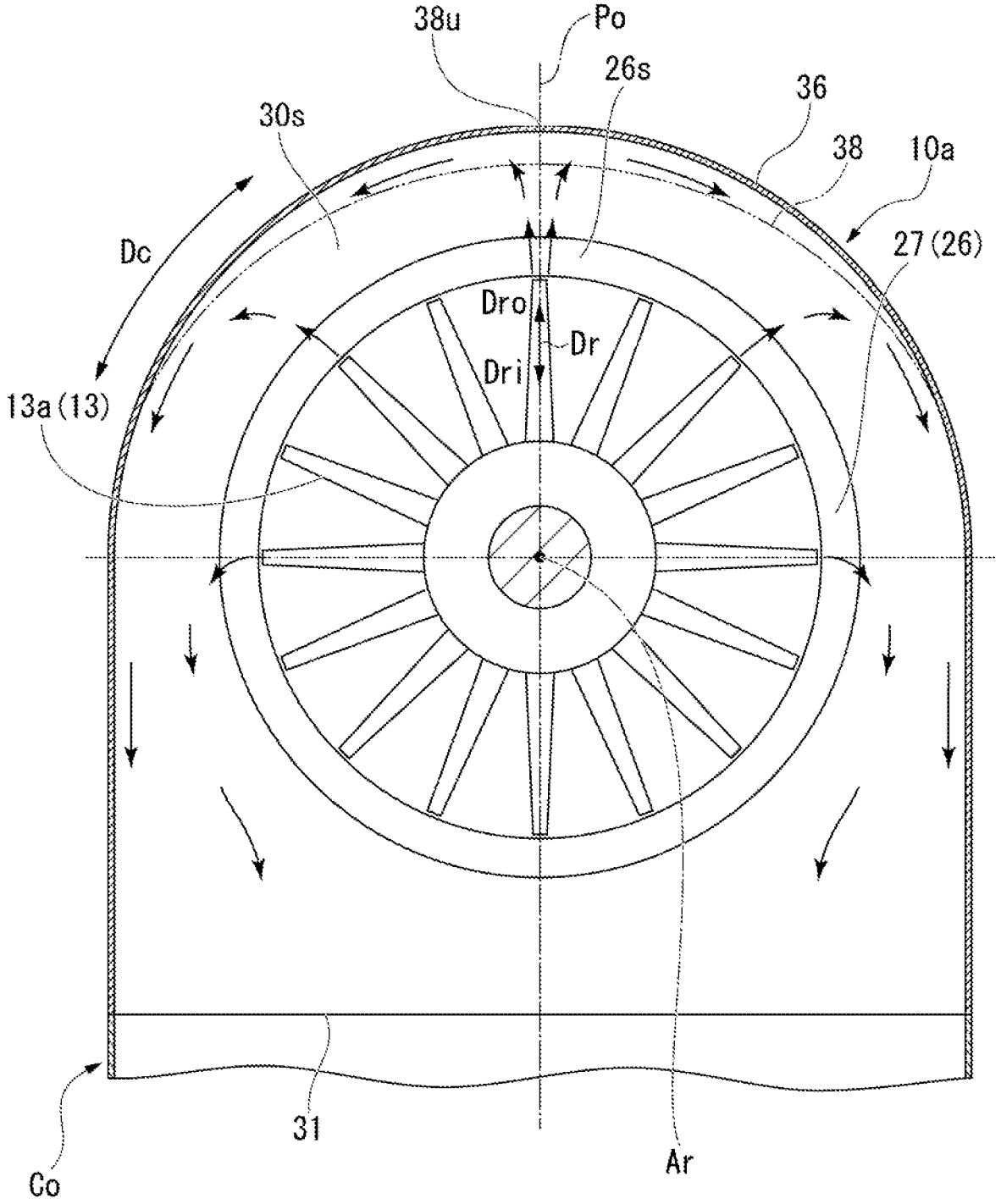
FIG. 3 is a cross-sectional view taken along the line III-III of FIG. 2.

The exhaust casing 25 has a diffuser 26 and an outer casing 30 as shown in FIG. 2. The diffuser 26 has an annular shape with respect to the axis Ar, and forms a diffuser space 26*s* that is directed gradually to the radially outward toward the axially downstream side Dad. The steam flowing out of the last rotor blade row 13*a* of the turbine rotor 11 flows into the diffuser space 26*s*. Further, the last rotor blade row 13*a* is a rotor blade row 13 disposed to be closest to the axially downstream side Dad among the plurality of rotor blade rows 13. The diffuser 26 has an outer diffuser (or a steam guide or a flow guide) 27 which defines an edge on the radially outer side Dro of the diffuser space 26*s*, and an inner diffuser (or a bearing cone) 29 which defines an edge on the radially inner side Dri of the diffuser space 26*s*. The outer diffuser 27 has an annular cross section perpendicular to the axis Ar, and gradually widens toward the radially outer side Dro toward the axially downstream side Dad. The inner diffuser 29 also has an annular cross section perpendicular to the axis Ar, and gradually widens to the radially outer side Dro toward the axially downstream side Dad. The outer diffuses 27 is connected to the inner casing 21. Further, the inner diffuser 29 is connected to the outer casing 30.

The outer casing 30 has an exhaust port 31. The exhaust port 31 opens downward in a vertical direction on the radially outer side Dro from the inside. A condenser Co that returns the steam to water is connected to the exhaust port 31. Therefore, the steam turbine ST of the present embodiment is a condensing steam turbine of a downward exhaust type. The outer casing 30 forms an exhaust space 30*s* which communicates with the diffuser 26. The exhaust space 30*s* widens the outer circumference of the diffuser 26 in the circumferential direction Dc with respect to the axis Ar, and guides the steam flowing from the diffuser space 26*s* to the exhaust port 31. The outer casing 30 has a downstream side end plate 32, an upstream side end plate 34, a side peripheral plate 36, and an inclined plate 38.

As shown in FIGS. 2 and 4, the downstream side end plate 32 widens from the edge on the radially outer side Dro of the inner diffuser 29 to the radially outer side Dro to define an edge on the axially downstream side Dad of the exhaust space 30*s*. The downstream side end plate 32 is substantially perpendicular to the axis Ar. A portion of the downstream side end plate 32 above the axis Ar has a substantially semicircular shape. On the other hand, a portion of the downstream side end plate 32 below the axis Ar has a substantially rectangular shape. A lower edge on the downstream side end plate 32 forms a part of the edge on the exhaust port 31.

The inclined plate 38 is disposed in a region on a side opposite to the exhaust port 31 on the basis of the axis Ar, that is, in a region above the axis Ar. The inclined plate 38 is connected to the edge on the radially outer side Dro of the downstream side end plate 32, and an upward edge on the downstream side end plate 32 in the present embodiment. The inclined plate 38 gradually widens toward the axially upstream side Dau from the upward edge on the downstream side end plate 32 to the radially outer side Dro. The inclined plate 38 defines a part of the edge on the radially outer side Dro of the exhaust space 30*s* in the portion above the axis A.

The side peripheral plate 36 is connected to the downstream side end plate 32 and the inclined plate 38, widens in the axial direction Da and widens in the circumferential direction Dc about the axis Ar to define a remaining portion of the edge on the radially outer side Dro of the exhaust space 30*s*. The side peripheral plate 36 has a semi-cylindrical shape in Which an upper side forms a semi-cylinder. The lower edge on the side peripheral plate 36 forms a part of the edge on the exhaust port 31.

The upstream side end plate 34 is disposed on the side closer to the axially upstream side Dau than the diffuser 26. The upstream side end plate 34 widens from the outer peripheral surface 210 of the inner casing 21 to the radially outer side Dro to define the edge on the axially upstream side Dau of the exhaust space 30*s*. The upstream side end plate 34 is substantially perpendicular to the axis Ar. Accordingly, the upstream side end plate 34 faces the downstream side end plate 32 at intervals in the axial direction Da. The lower edge on the upstream side end plate 34 forms a part of the edge on the exhaust port 31. Among the edges on the radially outer side Dro of the upstream side end plate 34, a portion excluding the portion forming the edge on the exhaust port 31 is connected to the side peripheral plate 36.

As shown in FIGS. 1 and 4, the outer casing 30 of the first steam turbine unit 10*a* and the outer casing 30 of the second steam turbine unit 10*b* are connected to each other and integrated.

As shown in FIG. 2, in the inclined plate 38, an edge (hereinafter referred to as an upstream edge) 38*u* on the axially upstream side Dau at a diametrically opposite position Po to the exhaust port 31 on the basis of the axis Ar is located on the axially upstream side Dau, on the basis of a virtual plane Pv that widens from the end on the radially outer side Dro of the inner diffuser 29 and is parallel to the downstream side end plate 32. Further, the diametrically opposite position Po in the inclined plate 38 is a position vertically above the axis Ar, as shown in FIGS. 2 and 4. Further, in the inclined plate 38, the edge on the axially downstream side Dad is a connection portion between the inclined plate 38 and the downstream side end plate 32.

The inclined plate 38 widens from the diametrically opposite position Po in the circumferential direction Dc with respect to the axis Ar, as shown in FIG. 4. The edge on the axially upstream side Dau of the inclined plate 38 is gradually displaced to the axially downstream side Dad from the diametrically opposite position Po toward the exhaust port 31 in the circumferential direction Dc with respect to the axis Ar. For this reason, a length in the axial direction Da of the inclined plate 38 is gradually shortened from the diametrically opposite position Po toward the exhaust port 31 in the circumferential direction Dc with respect to the axis Ar. The inclined plate 38 does not exist below the axis Ar. In other words, the inclined plate 38 does not exist on the exhaust port 31 side on the basis of the axis Ar.

An angle of an inclined inner surface 39 which defines the exhaust space 30*s* in the inclined plate 38 will be described.

Here, an angle of the inclined inner surface 39 with respect to a tangential line Lt at the end on the radially outer side Dro of the inner peripheral surface 27*pi* of the outer diffuser 27, which is an angle on the axially upstream side Dau on the basis of the tangential line Lt in the exhaust space 30*s*, is defined as an upstream side angle θ1. Further, an angle of the inclined inner surface 39 with respect to the tangential line Lt, which is an angle of the axially downstream side Dad on the basis of the tangential line Lt in the exhaust space 30*s*, is defined as a downstream side angle θ2. In the present embodiment, the upstream side angle θ1 is greater than the downstream side angle θ2. The upstream side angle θ1 is, for example, 100° or more.

Figure 5:
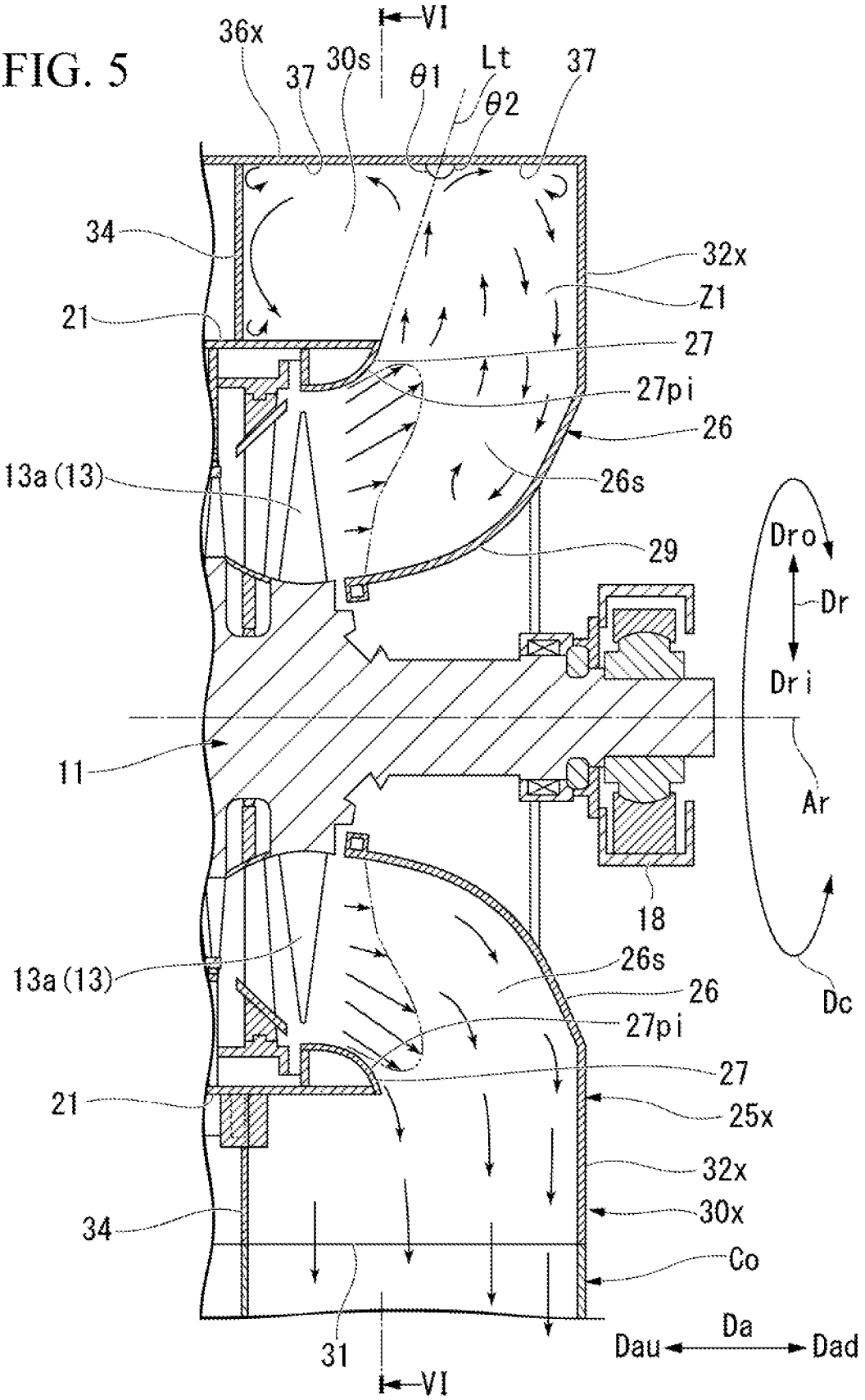
FIG. 5 is a cross-sectional view of main parts of a steam turbine in a comparative example.
Figure 6:
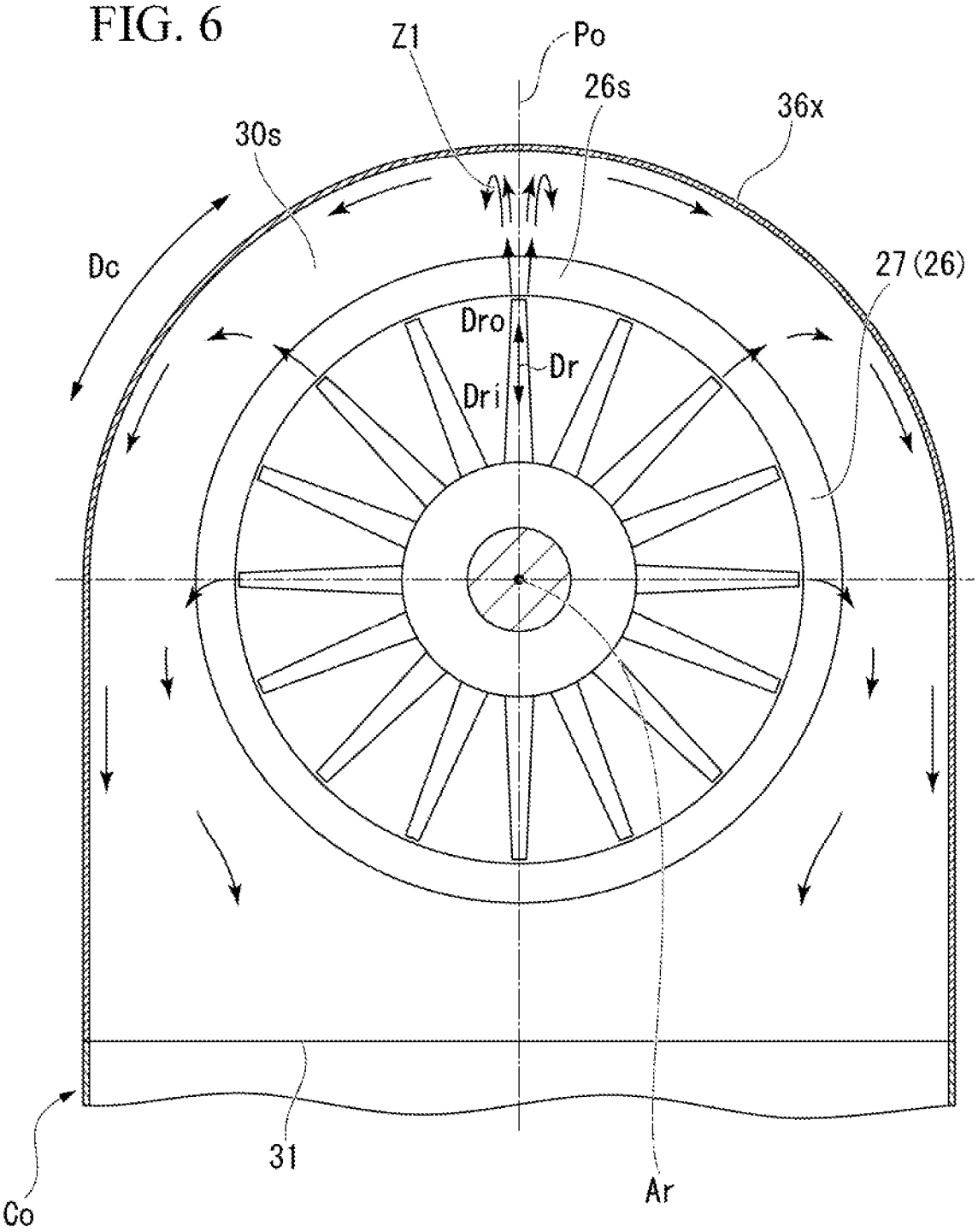
FIG. 6 is a cross-sectional view taken along the line VI-VI of FIG. 5.

Next, before describing the effects of the exhaust casing 25 described above, an exhaust casing of a comparative example will be described with reference to FIGS. 5 and 6.

As in the exhaust casing 25 of the present embodiment, an exhaust casing 25*x* of the comparative example has a diffuser 26 and an outer casing 30*x*. The diffuser 26 of the comparative example is the same as the diffuser 26 of the present embodiment. On the other hand, the outer casing 30*x* of the comparative example is different from the outer casing 30 of the present embodiment. The outer casing 30*x* of the comparative example has ae downstream side end plate 32*x*, an upstream side end plate 34, and a side peripheral plate 36*x*, but does not have the inclined plate 38 of the outer casing 30 of the present embodiment. For this reason, in the comparative example, the side peripheral plate 36*x* that widens in the axial direction Da and extends in the circumferential direction Dc around the axis Ar is directly connected to the upward edge on the downstream side end plate 32*x*. In a virtual plane including the axis Ar, the angle of the side peripheral plate 36*x* to the downstream side end plate 32*x* is substantially 90°.

In the present comparative example, an angle of the side peripheral inner surface 37 which defines the exhaust space 30*s* by the side peripheral plate 36*x* with respect to the tangential line Lt at the end on the radially outer side Dro of the inner peripheral surface 27*pi* of the outer diffuser 27 will be described. Here, an angle of the side peripheral inner surface 37 with respect to the tangential line Lt, which is an angle on the axially upstream side Dau on the basis of the tangential line Lt in the exhaust space 30*s*, is defined as an upstream side angle θ1. Further, an angle with respect to the side peripheral inner surface 37 with respect to the tangential line Lt, which is an angle of the axially downstream side Dad on the basis of the tangential line Lt in the exhaust space 30*s*, is defined as a downstream side angle θ2. In the present comparative example, unlike the present embodiment, the upstream side angle θ1 is smaller than the downstream side angle θ2. In other words, in the present comparative example, the downstream side angle θ2 is greater than the upstream side angle θ1.

As a result of analyzing the flow of the steam in the exhaust casing 25*x* of the present comparative example, it was found that the steam flows in the exhaust casing 25*x* as follows.

In a region on the side opposite to the exhaust port 31 on the basis of the axis Ar in the exhaust space 30*s*, the flowing direction of the steam having flowed into the exhaust space 30*s* along the inner peripheral surface 27*pi* of the outer diffuser 27 becomes a substantially tangential direction in which the aforementioned tangential line Lt extends. When the steam flowing substantially in the tangential direction collides with the side peripheral inner surface 37 of the side peripheral plate 36*x* in a region on the side opposite to the exhaust port 31 on the basis of the axis Ar in the exhaust space 30*s*, some parts of the steam flow to the axially upstream side Dau along the side peripheral inner surface 37, and other parts thereof flow to the axially downstream side Dad along the side peripheral inner surface 37.

The flowing direction of the steam having flowed to the axially upstream side Dau along the side peripheral inner surface 37 gradually becomes the circumferential direction, and the steam flows to the exhaust port 31 side along the side peripheral inner surface 37. On the other hand, the steam having flowed to the axially downstream side Dad along the side peripheral inner surface 37 flows to a base part side of the last rotor blade row 13*a* along the downstream side end plate 32*x* and the inner diffuser 29. That is, in the diffuser space 26*s*, although the steam flows to the radially outer side Dro on the outer diffuser 27 side, the steam flows backward to the radially inner side Dri on the inner diffuser 29 side. The steam having flowed backward in the diffuser space 26*s* approaches the outer diffuser 27 and flows to the radially outer side Dro again. For this reason, a circulation region Z1 in which the steam circulates is formed in the exhaust casing 25*x*.

In the comparative example, as described above, since the downstream side angle θ2 is greater than the upstream side angle θ1, when the steam flowing substantially in the aforementioned tangential direction collides with the side peripheral inner surface 37 of the side peripheral plate 36*x*, the amount of steam flowing to the axially downstream side Dad along the side peripheral inner surface 37 becomes greater than the amount of steam flowing to the axially upstream side Dau along the side peripheral inner surface 37. For this reason, in the comparative example, the amount of steam flowing backward in the exhaust casing 25*x* increases. In other words, in the comparative example, the circulation region Z1 in the exhaust casing 25*x* increases.

As described above, in the comparative example, since a part of the flow passage cross-sectional area in the exhaust casing 25*x* cannot be effectively used for exhausting the steam, the pressure loss of the steam in the exhaust casing 25*x* increases.

In a case of a low load operation in which the flow rate of steam flowing into the steam turbine ST is small, or in a case in which the inside of the condenser Co has a low degree of vacuum, the steam drifts to the radially outer side Dro (a tip side) of the rotor blade. For this reason, in the steam having flowed into the diffuser space 26*s*, the flow rate of the steam on the outer diffuser 27 side becomes higher than the flow rate of the steam on the inner diffuser 29 side. That is, in the case of the low load operation or in the case in which the inside of the condenser Co has a low degree of vacuum, the flow of steam along the inner peripheral surface 27*pi* of the outer diffuser 27 increases. Therefore, in the comparative example, in the case of the low load operation or in the case in which the inside of the condenser Co has a low degree of vacuum, the amount of steam flowing backward in the exhaust casing 25*x* further increases, and the pressure loss of the steam in the exhaust casing 25*x* further increases.

On the other hand, in the region on the exhaust port 31 side on the basis of the axis Ar in the exhaust space 30*s*, the flowing direction of the steam having flowed into the exhaust space 30*s* along the inner peripheral surface 27*pi* of the outer diffuser 27 becomes a direction that includes a component in the tangential direction in which a tangential line at the end on the radially outer side Dro of the inner peripheral surface 27*pi* extends and a directional component on a side close to the exhaust port 31 in the circumferential direction Dc with respect to the axis Ar. This is because the steam containing a large amount of components in the circumferential direction De flows in the region on the exhaust port 31 side from the region on the side opposite to the exhaust port 31 in the exhaust casing 25*x*. For this reason, in the region on the exhaust port 31 side, the back flow of the steam does not substantially occur as in the region on the side opposite to the exhaust port 31.

In the case of the present embodiment, as described above, the upstream side angle θ1 is greater than the downstream side angle θ2. Therefore, in the present embodiment, even if the steam flowing substantially in the tangential direction mentioned above collides with the inclined inner surface 39 of the inclined plate 38 in the region on the side opposite to the exhaust port 31, the amount of steam flowing to the axially upstream side Dau along the inclined inner surface 39 becomes greater than the amount of steam flowing to the axially downstream side Dad along the inclined inner surface 39. For this reason, in the present embodiment, the amount of steam flowing backward in the exhaust casing 25 becomes smaller than that in the comparative example. In other words, in the present embodiment, the circulation region Z1 in the exhaust easing 25 becomes smaller than that in the comparative example, and the number of portions that can be effectively used for exhausting the steam in the steam flow passage cross-sectional area in the exhaust casing 25 increases.

Therefore, in the present embodiment, the pressure loss of the steam in the exhaust casing 25 becomes smaller than that in the comparative example, and it is possible to increase the amount of pressure recovery of the steam flowing out of the last rotor blade row 13*a*.

Incidentally, in the region on the side opposite to the exhaust port 31 the flowing direction of the steam having flowed into the exhaust space 30*s* along the inner peripheral surface 27*pi* of the outer diffuser 27 does not exactly become the tangential direction in which the tangential line Lt at the end on the radially outer side Dro of the inner peripheral surface 27*pi* of the outer diffuser 27 extends. The steam having flowed into the exhaust space 30*s* along the inner peripheral surface 27*pi* of the outer diffuser 27 flows slightly toward the axially upstream side Dau, while flowing in the tangential direction due to the presence of the downstream side end plate 32. That is, the flowing direction of the steam having flowed into the exhaust space 30*s* along the inner peripheral surface 27*pi* of the outer diffuser 27 slightly includes the directional component on the axially upstream side Dau in addition to the component in the tangential direction.

Therefore, if the upstream edge 38*u* at the diametrically opposite position Po to the exhaust port 31 on the basis of the axis Ar is located on the tangential line Lt in the inclined plate 38, the steam having flowed into the exhaust space 30*s* along the inner peripheral surface 27*pi* of the outer diffuser 27 collides with a bounder between the inclined plate 38 and the side peripheral plate 36. Therefore, in the present embodiment, the upstream edge 38*u* at the diametrically opposite position Po to the exhaust port 31 on the basis of the axis Ar is located on the axially upstream side Dau in the inclined plate 38, on the basis of a virtual plane Pv that widens from the end on the radially outer side Dro of the inner diffuser 29 and is parallel to the downstream side end plate 32 so that the steam having flowed into the exhaust space 30*s* along the inner peripheral surface 27*pi* of the outer diffuser 27 collides with the inclined plate 38.

In the present embodiment, as described above, the inclined plate 38 does not exist on the exhaust port 31 side on the basis of the axis Ar. However, a part of the inclined plate 38 may exist on the exhaust port 31 side on the basis of the axis Ar. However, as described above, since there is substantially no back flow of steam in the region on the exhaust port 31 side, there is no meaning of providing the inclined plate 38 on the exhaust port 31 side. Moreover, when the inclined plate 38 is provided, since the flow passage cross-sectional area in the exhaust casing 25 decreases, the pressure loss of steam in the region on the exhaust port 31 side increases. Therefore, it is preferable that the inclined plate 38 does not exist on the exhaust port 31 side on the basis of the axis Ar as in the present embodiment.

Second Embodiment

Figure 7:
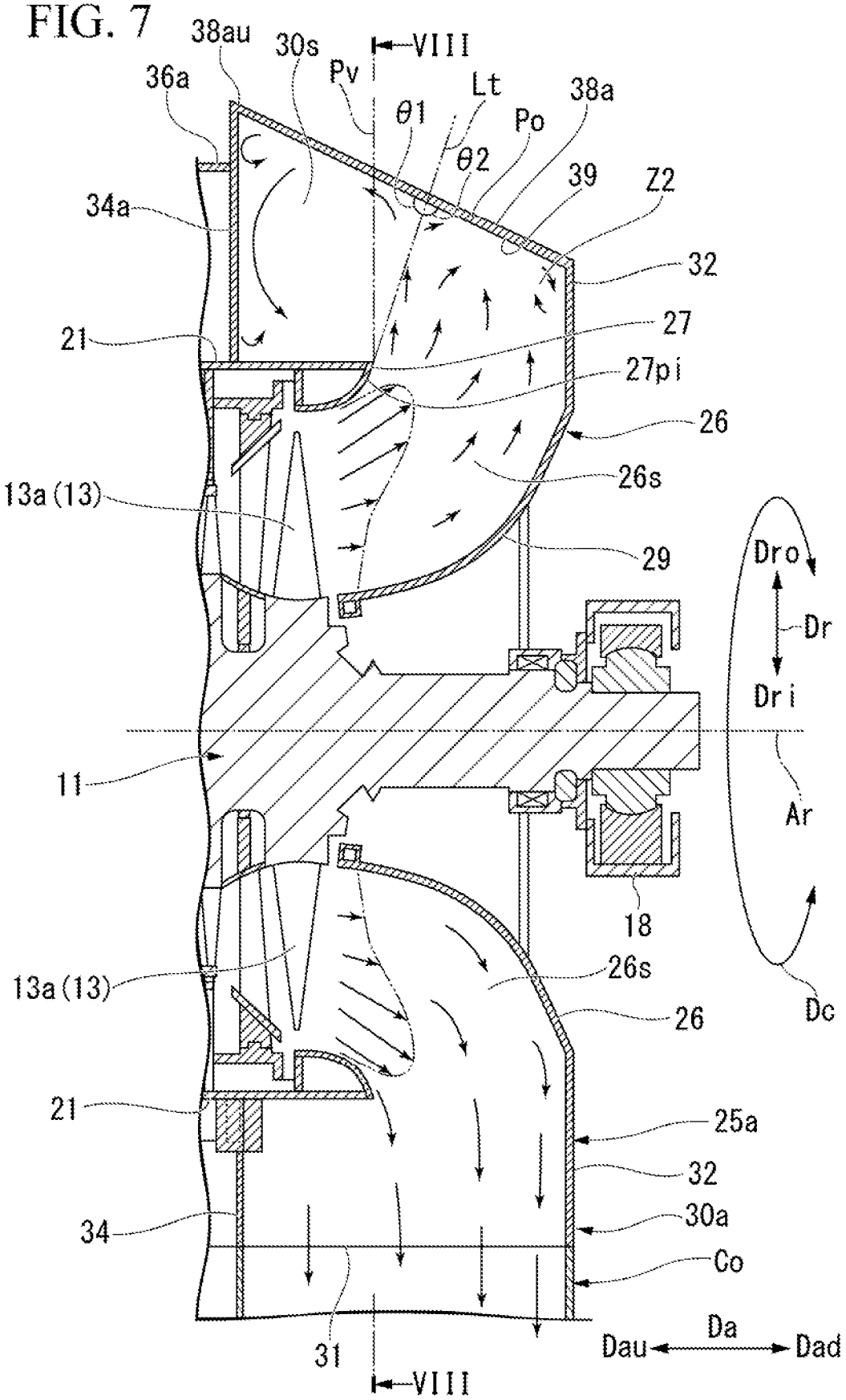
FIG. 7 is a cross-sectional view of main parts of a steam turbine according to a second embodiment of the present invention.

A second embodiment of a steam turbine according to the present invention will be described with reference to FIGS. 7 and 8.

The steam turbine of the second embodiment differs only in the configuration of the outer casing 30 in the steam turbine of the first embodiment. As shown in FIGS. 7 and 8, the outer casing 30*a* of the present embodiment also has a downstream side end plate 32, an upstream side end plate 34*a*, a side peripheral plate 36*a*, and an inclined plate 38*a*, as in the first embodiment. However, the inclined plate 38*a* of the present embodiment is different from the inclined plate 38 of the first embodiment. In the inclined plate 38*a* of the present embodiment, an upstream edge 38*au* at a diametrically opposite position Po to the exhaust port 31 on the basis of the axis Ar is connected to the edge on a radially outer side Dro of the upstream side end plate 34*a*. Therefore, in the present embodiment, a length in the axial direction Da at the diametrically opposite position Po of the inclined plate 38*a* is longer than the same length of the inclined plate 38 of the first embodiment.

Figure 8:
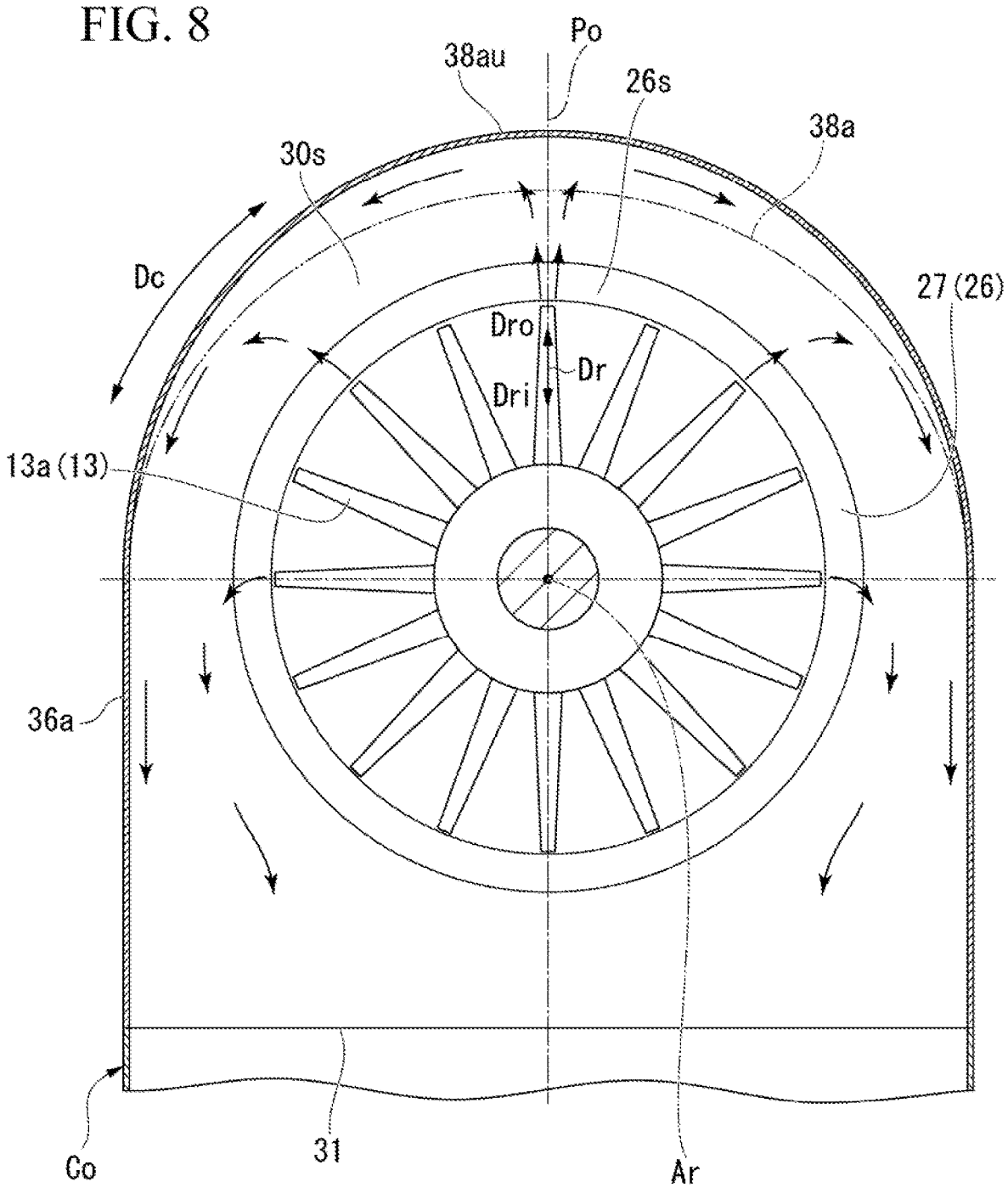
FIG. 8 is a cross-sectional view taken along line VIII-VIII of FIG. 7.

The inclined plate 38*a* of the present embodiment also widens in the circumferential direction Dc with respect to the axis Ar from the diametrically opposite position Po, as shown in FIG. 8. The edge on the upstream edge 38*au* of the inclined plate 38*a* is gradually displaced to the axially downstream side Dad from the diametrically opposite position Po toward the exhaust port 31 in the circumferential direction Dc with respect to the axis Ar. For this reason, the length in the axial direction Da of the inclined plate 38*a* according to the present embodiment is also gradually shortened from the diametrically opposite position Po toward the exhaust port 31 in the circumferential direction Dc with respect to the axis Ar, as in the inclined plate 38 according to the first embodiment. In the inclined plate 38*a* of the present embodiment, as described above, the length in the axial direction Da at the diametrically opposite position Po of the inclined plate 38*a* is longer than the same length of the inclined plate 38 of the first embodiment. Therefore, the position closest to the exhaust port 31 in the inclined plate 38*a* of the present embodiment is closer to the exhaust port 31 than the position closest to the exhaust port 31 in the inclined plate 38 of the first embodiment. However, in the present embodiment, the inclined plate 38*a* also does not exist below the axis Ar, in other words, on the exhaust port 31 side on the basis of the axis Ar.

In the present embodiment, in the region on the side opposite to the exhaust port 31 in the exhaust space 30*s*, the flowing direction of the steam having flowed into the exhaust space 30*s* along the inner peripheral surface 27*pi* of the outer diffuser 27 also becomes a substantially tangential direction in which the tangential line Lt at the end on the radially outer side Dro of the inner peripheral surface 27*pi* of the outer diffuser 27 extends. When the steam collides with the inclined inner surface 39 of the inclined plate 38*a*, most of the steam flows to the axially upstream side Dau along the inclined inner surface 39. In the present embodiment, as described above, the length in the axial direction Da at the diametrically opposite position Po of the inclined plate 38*a* is longer than the same length of the inclined plate 38 of the first embodiment. For this reason, in the present embodiment, after the steam collides with the inclined inner surface 39 of the inclined plate 38*a*, the flow of the steam flowing to the axially upstream side Dau alone the inclined inner surface 39 is stabilized. As a result, in the present embodiment, after the steam collides with the inclined inner surface 39 of the inclined plate 38*a*, the flow rate of the steam flowing to the axially downstream side Dad along the inclined inner surface 39 becomes smaller than that in the first embodiment.

Therefore, in the present embodiment, the amount of steam flowing backward in the exhaust casing 25*a* becomes smaller than that in the first embodiment, and the circulation region Z1 (see FIG. 5) of the steam in the exhaust casing 25*a* decreases. For this reason, in the present embodiment, the pressure loss of steam in the exhaust casing 25*a* becomes smaller than that in the first embodiment, and it is possible to increase the amount of pressure recovery of the steam flowing out from the last rotor blade row 13*a*.

Further, in the present embodiment, although the position in the radial direction Dr of the side peripheral plate 36*a* and the position in the radial direction Dr of the upstream edge 38*au* of the inclined plate 38*a* at the diametrically opposite position Po are different from each other, these positions may be made to coincide with each other.

Third Embodiment

Figure 9:
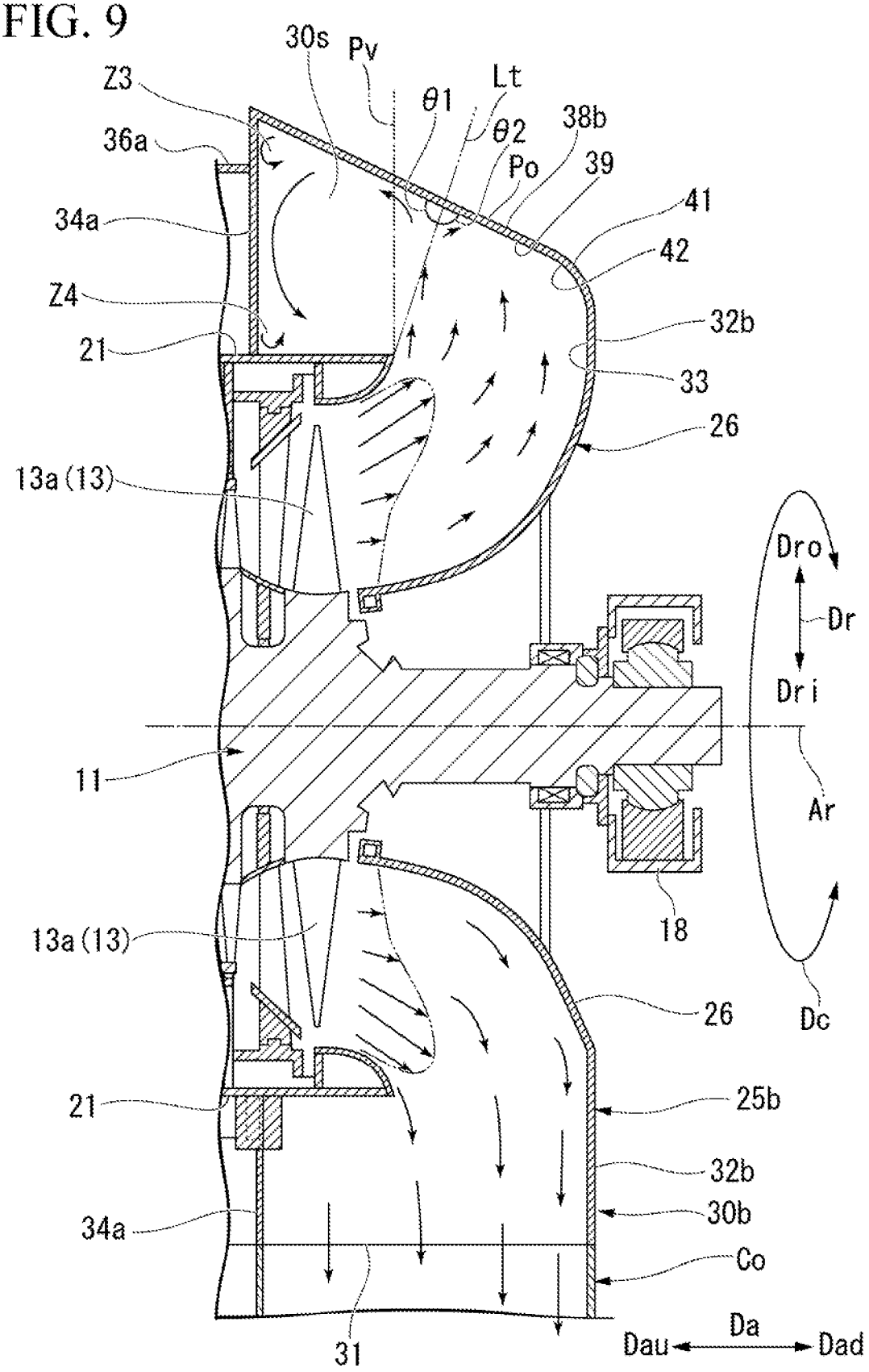
FIG. 9 is a cross-sectional view of main parts of a steam turbine according to a third embodiment of the present invention.

A third embodiment of a steam turbine according to the present invention will be described with reference to FIG. 9.

The steam turbine of the third embodiment differs only in the configuration of the outer casing 30*a* in the steam turbine of the second embodiment. The outer casing 30*b* of the present embodiment also has a downstream side end plate 32*b*, an upstream side end plate 34*a*, a side peripheral plate 36*a*, and an inclined plate 38*b*, as in the second embodiment. The outer casing 30*b* of the present embodiment further has a downstream side connection plate 41. The downstream side connection plate 41 connects an edge on the radially outer side Dro of the downstream side end plate 32*b* and an edge on the axially downstream side Dad of the inclined plate 38*b*. The downstream side connection plate 41 has a curved surface 42 that is gradually bent to the axially upstream side Dau from the downstream side inner surface 33 defining the exhaust space 30*s* by the downstream side end plate 32*b* toward the radially outer side Dro, and smoothly connects the downstream side inner surface 33 and the inclined inner surface 39 of the inclined plate 38*b*.

In the outer casing 30*a* of the second embodiment, a circulation region Z2 (see FIG. 7) of steam is formed at a corner between the downstream side end plate 32 and the inclined plate 38*a*. Therefore, in the present embodiment, by interposing the downstream side connection plate 41 between the downstream side end plate 32*b* and the inclined plate 38*b*, the corner between the downstream side end plate 32*b* and the inclined plate 38*b* is eliminated. As a result, in the present embodiment, the circulation region Z2 of the steam in the vicinity of the edge on the radially outer side Dro of the downstream side end plate 32*b* decreases, or the circulation region Z2 of the steam is eliminated.

Therefore, in the present embodiment, there are more portions that can be effectively used for exhausting the steam in the steam flow passage cross-sectional area in the exhaust casing 25*b* than those in the second embodiment, and it is possible to increase the amount of pressure recovery of the steam flowing out from the last rotor blade row 13*a*.

In addition, although the outer casing 30*a* of the second embodiment is deformed in the present embodiment, the outer casing 30 of the first embodiment may be deformed as in the present embodiment.

Fourth Embodiment

Figure 10:
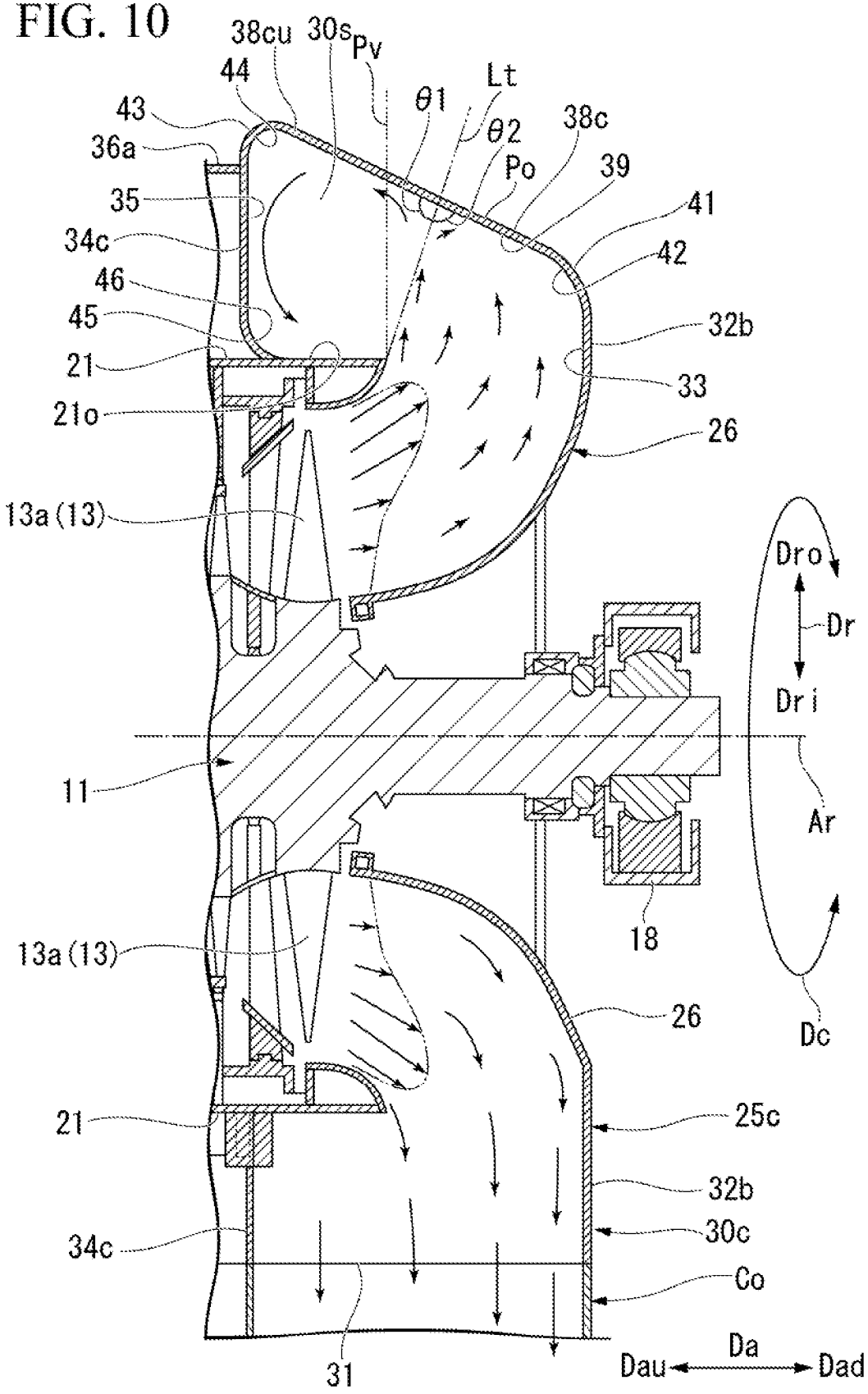
FIG. 10 is a cross-sectional view of main parts of a steam turbine according to a fourth embodiment of the present invention.

A fourth embodiment of a steam turbine according to the present invention will be described with reference to FIG. 10.

The steam turbine of the fourth embodiment differs only in the configuration of the outer casing 30*b* in the steam turbine of the third embodiment. The outer casing 30*c* of the present embodiment also has a downstream side end plate 32*b*, an upstream side end plate 34*c*, a side peripheral plate 36*a*, an inclined plate 38*c*, and a downstream side connection plate 41, as in the third embodiment. The outer casing 30*c* of the present embodiment further has a first upstream side connection plate 43 and a second upstream side connection plate 45.

The first upstream side connection plate 43 connects an edge on an upstream edge 38*cu* of the inclined plate 38*c* and an edge on the radially outer side Dro of the upstream side end plate 34*c*. The first upstream side connection plate 43 has a curved surface 11 that is gradually bent to the radially inner side Dri from the inclined inner surface 39 of the inclined plate 38*c* toward the axially upstream side Dau, and smoothly connects the inclined inner surface 39 of the inclined plate 38*c* and the upstream side inner snake 35 defining the exhaust space 30*s* by the upstream side end plate 34*e*. The second upstream side connection plate 45 connects an edge on the radially inner side Dri of the upstream side end plate 34*c* and the inner casing 21. The second upstream side connection plate 45 has a curved surface 46 that is gradually bent to the axially downstream side Dad from the upstream side inner surface 35 of the upstream side end plate 34*c* toward the radially inner side Dri, and smoothly connects the upstream side inner surface 35 of the upstream side end plate 34*c* and the outer peripheral surface 21*o* defining the exhaust space 30*s* by the inner casing 21.

In the outer casing 30*b* of the third embodiment, a circulation region Z3 (see FIG. 9) of steam is formed at a corner between the inclined plate 38*b* and the upstream side endplate 34*a*. Therefore, in the present embodiment, by interposing with the first upstream side connection plate 43 between the inclined plate 38*c* and the upstream side end plate 34*c*, the coiner between the inclined plate 38*c* and the upstream side end plate 34*e* is eliminated. As a result, in the present embodiment, the circulation region Z3 of the steam in the vicinity of the edge on the radially outer side Dro of the upstream side end plate 34*c* becomes smaller, or the circulation region Z3 of the steam is eliminated. Furthermore, in the outer casing 30*b* of the third embodiment, a circulation region Z4 (see FIG. 9) of steam is formed at the corner between the upstream side end plate 34*a* and the inner casing 21. Therefore, in the present embodiment, in order to eliminate the corner between the upstream side end plate 34*c* and the inner casing 21, by interposing the second upstream side connection plate 45 between the upstream side end plate 34*e* and the inner casing 21, the corner between the upstream side end plate 34*c* and the inner casing 21 is eliminated. As a result, in the present embodiment, the circulation region Z4 of the steam in the vicinity of the edge on the radially inner side Dri of the upstream side end plate 34*c* decreases, or the circulation region Z4 of the steam is eliminated.

Therefore, in the present embodiment, there are more portions that can be effectively used for exhausting the steam in the steam flow passage cross-sectional area in the exhaust casing 25*c* than those in the third embodiment, and it is possible to increase the amount of pressure recovery of the steam flowing out of the last rotor blade row 13*a*.

In addition, although the outer casing 30*b* of third embodiment is deformed in the present embodiment, the outer casings of first embodiment and the second embodiment may be deformed as in the present embodiment. That is, the first upstream side connection plate 43 may be connected to the edge on the radially outer side Dro of the upstream side end plate of the first embodiment and the second embodiment, and the second upstream side connection plate 45 may be connected to the edge on the radially inner side Dri of the upstream side end plate.

First Modified Example of First Embodiment

Figure 11:
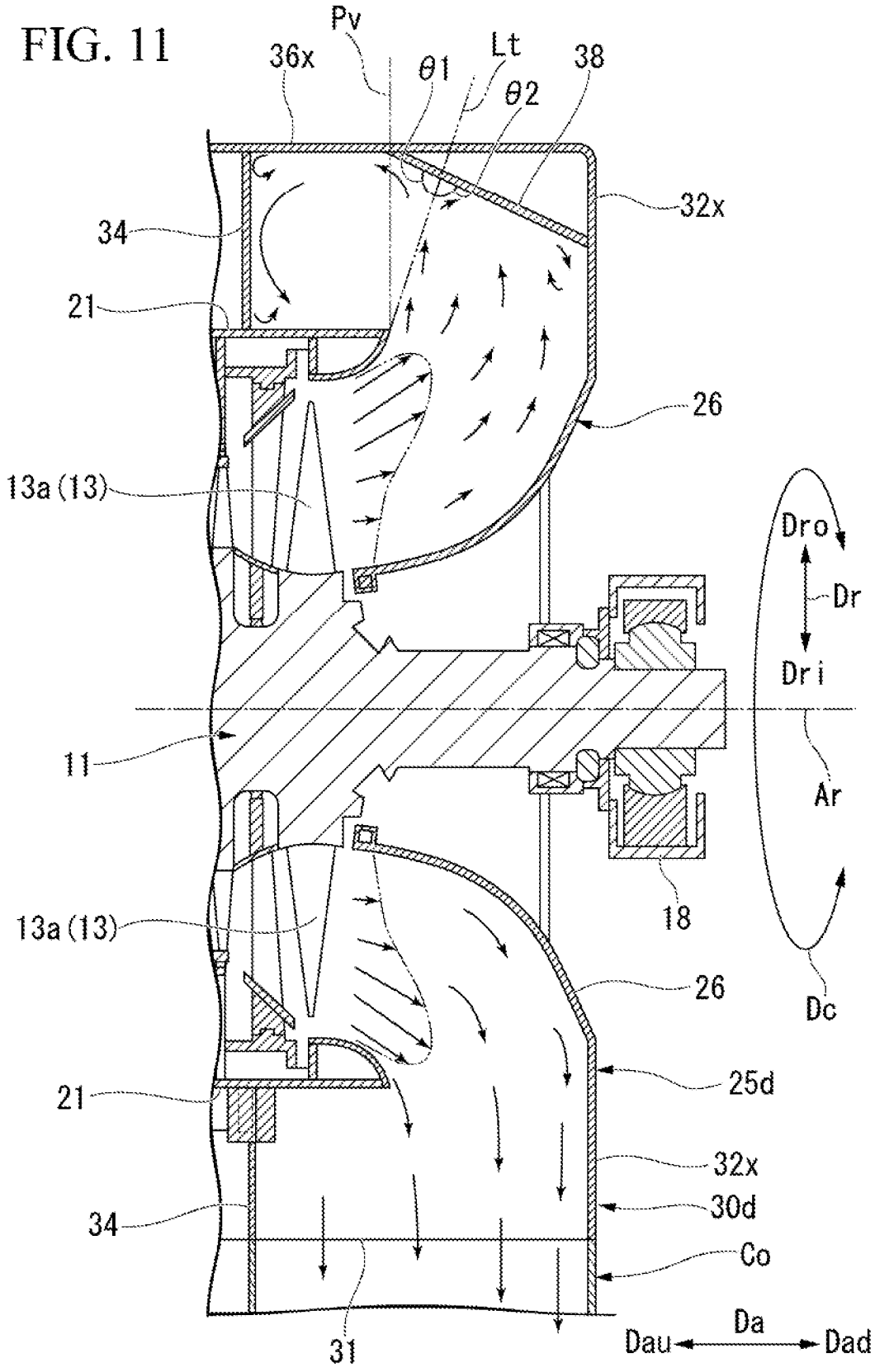
FIG. 11 is a cross-sectional view of main parts of a steam turbine according to first modified example of the first embodiment of the present invention.

A first modified example of the steam turbine of the first embodiment will described with reference to FIG. 11.

The steam turbine of the present modified example differs only in the configuration of the outer casing 30 in the steam turbine of the first embodiment. The outer casing 30*d* of the present modified example is obtained by adding the inclined plate 38 of the first embodiment in the outer casing 30*x* (see FIG. 5) of the comparative example. For this reason, the shape of the exhaust space 30*s* of the present modified example is the same as the shape of the exhaust space 30*s* of the first embodiment.

Therefore, as in the first embodiment, in the present modified example, the circulation region Z1 (see FIG. 5) in the exhaust casing 25*d* also becomes smaller than that in the comparative example, and the number of portions that can be effectively used for exhausting the steam in the steam flow passage cross-sectional area in the exhaust casing 25*d* increases.

Further, as described above, the outer casing 30*d* of the present modified example is obtained by adding the inclined plate 38 of the first embodiment in the outer casing 30*x* of the comparative example. For this reason, when the outer casing of the existing steam turbine has the same shape as that of the outer casing 30*x* of the comparative example, only by performing a simple remodeling work on the outer casing 30*x*, as in the first embodiment, it is possible to increase the number of portions that can be effectively used for exhausting the steam in the steam flow passage cross-sectional area in the exhaust casing 25*d* as compared to the comparative example.

Further, any one plate or a plurality of plates among the downstream side connection plate 41 of the third embodiment, the first upstream side connection plate 43 of the fourth embodiment, and the second upstream side connection plate 45 may be added in the outer casing 30*x* of the comparative example.

Second Modified Example of First Embodiment

Figure 12:
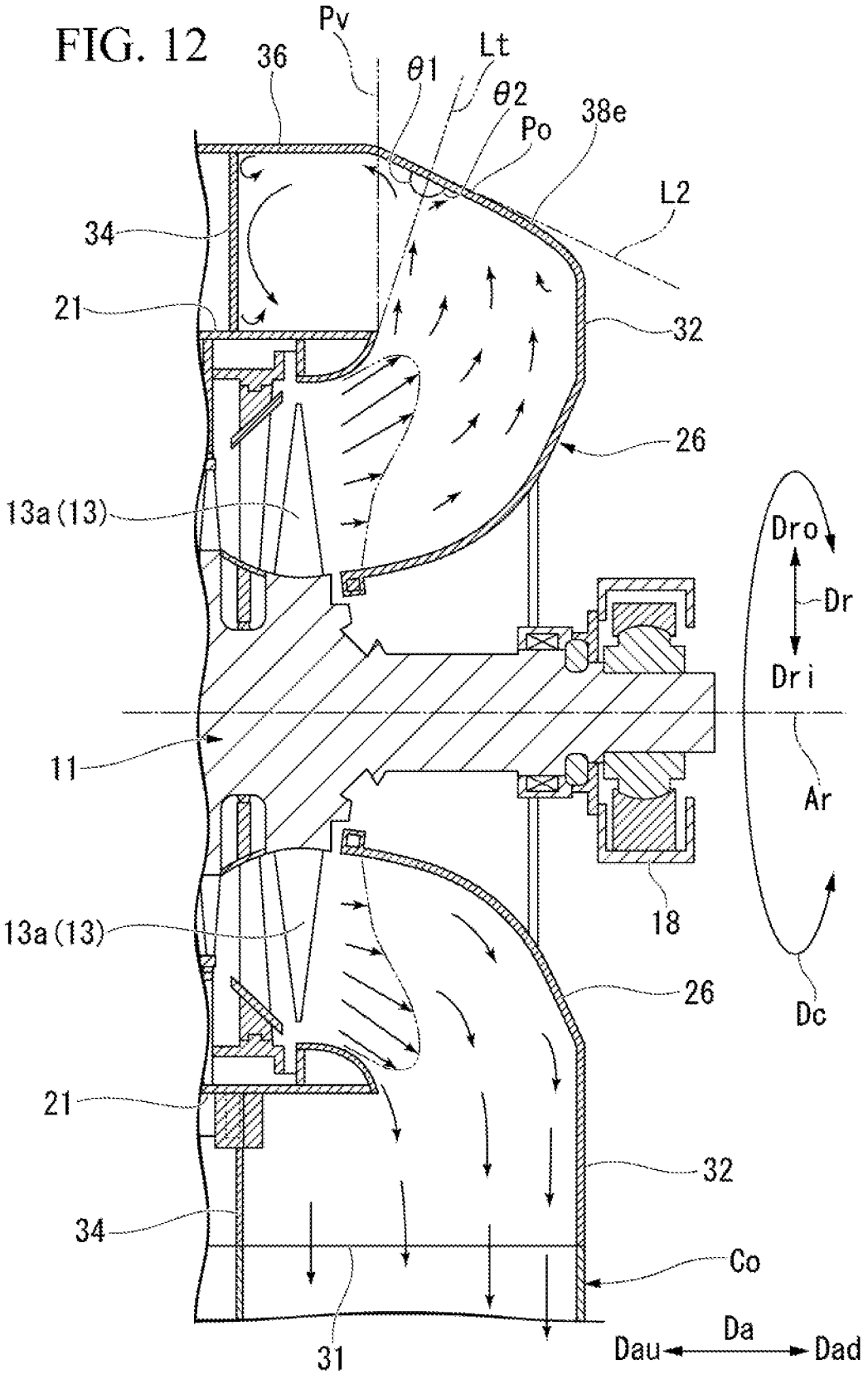
FIG. 12 is a cross-sectional view of main parts of a steam turbine according to a second modified example of the first embodiment of the present invention.

A second modified example of the steam turbine of the first embodiment will described with reference to FIG. 12.

The steam turbine of the present modified example differs only in the shape of the inclined plate 38 in the steam turbine of the first embodiment. In the inclined plate 38 of the first embodiment, a cross-sectional shape due to a virtual plane including the axis Ar is a linear shape. However, in the inclined plate, a cross-sectional shape due to the virtual plane including the axis Ar may be a curved shape. That is, as shown in FIG. 12, in the inclined plate 38*e* of the present modified example, a cross-sectional shape due to the virtual plane Pv including the axis Ar is a smooth concave curve shape toward the radially outer side Dro. Even in this case, the upstream side angle θ1 is greater than the downstream side angle θ2 at all positions on the diametrically opposite position Po in the inclined inner surface 39 of the inclined plate 38*e*. In FIG. 12, a two-dot chain line L2 drawn along the inclined plate 38*e* indicates the inclined plate having a linear cross-sectional shape due to the virtual plane including the axis Ar.

Other Modified Examples

The downstream side end plates in the outer casing of the above embodiments are all perpendicular to the axis Ar. However, as long as the angle of the downstream side end plate with respect to the axis Ar is an angle closer to 90° than the angle of the tangential line Lt at the end on the radially outer side Dro of the inner peripheral surface 27*pi* of the outer diffuser 27 with respect to the axis Ar, other angles may be adopted Although the steam turbines of the above embodiments are all the lower exhaust type, the steam turbines may be of a side exhaust type. In this case, for example, when the exhaust port exists on the left side on the basis of the axis Ar, the inclined plate is provided in the region on the right side on the basis of the axis Ar.

Each of the outer casings of the above embodiments has an upstream side end plate. However, in the case of the branched exhaust type, by making the exhaust space 30*s* of the first steam turbine unit 10*a* communicate with the exhaust space 30*s* of the second steam turbine unit 10*b* in a region on the side opposite to the exhaust port 31 of the basis of the axis Ar, the upstream side end plate can be omitted.

Although all the steam turbines of the above-described embodiments are the branched exhaust type, the present invention may be applied to a steam turbine that does not divide the steam.

INDUSTRIAL APPLICABILITY

In the exhaust casing according to an aspect of the present invention, the amount of pressure recovery can be increased by reducing the pressure loss of steam.

REFERENCE SIGNS LIST

10*a* First steam turbine unit
10*b* Second steam turbine unit
11 Turbine rotor
12 Rotor shaft
13 Rotor blade row
13*a* Last rotor blade row
17 Stator blade row
18 Bearing
19 Steam inflow pipe
20 Casing
21 Inner casing
21*o* Outer peripheral surface
25, 25*a*, 25*b*, 25*c*, 25*d*, 25*x* Exhaust casing
26 Diffuser

26*s* Diffuser space
27 Outer diffuser
27*pi* Inner peripheral surface
29 Inner diffuser
30, 30*a*, 30*b*, 30*c*, 30*d*, 30*x* Outer casing
30*s* Exhaust space
31 Exhaust port
32, 32*b* Downstream side end plate
33 Downstream side inner surface
34, 34*a*, 34*c* Upstream side end plate
35 Upstream side inner surface
36, 36*a* Side peripheral plate
37 Side peripheral inner surface
38*a*, 38*b*, 38*c*, 38*e* Inclined plate
38*u*, 38*au*, 38*cu* Upstream edge
39 Inclined inner surface
41 Downstream side connection plate
42 Curved surface
43 First upstream side connection plate
44 Curved surface
45 Second upstream side connection plate
46 Curved surface
Co Condenser
ST Steam turbine
Ar Axis
Po Diametrically opposite position
Lt Tangential line
Pv Virtual plane
Z1, Z2, Z3, Z4 Circulation region
θ1 Upstream side angle
θ2 Downstream side angle
Da Axial direction
Dau Axially upstream side
Dad Axially downstream side
Dc Circumferential direction
Dr Radial direction
Dri Radially inner side
Dro Radially outer side

The invention claimed is:

1. An exhaust casing which is configured to guide steam flowing out of a last rotor blade row of a steam turbine rotor rotating about an axis to an outside, the exhaust casing comprising:

a diffuser into which the steam flowing out of the last rotor blade row flows and which has an annular shape with respect to the axis, and forms a diffuser space directed gradually to a radially outer side with respect to the axis toward an axially downstream side; and an outer casing which has an exhaust port opening toward the radially outer side, communicates with the diffuser, and widens an outer circumference of the diffuser in a circumferential direction with respect to the axis to form an exhaust space which is configured to guide the steam flowing in from the diffuser space to the exhaust port, wherein the diffuser has:

an outer diffuser which has an annular cross section perpendicular to the axis and gradually widens to the radially outward toward the axially downstream side to define an edge on the radially outer side of the diffuser space, and an inner diffuser which has an annular cross section perpendicular to the axis, and gradually widens to the radially outward toward the axially downstream side to define an edge on a radially inner side of the diffuser space with respect to the axis, the outer casing has:

a downstream side end plate which widens to the radially outward from the edge on the radially outer side of the inner diffuser to define an edge on the axially downstream side of the exhaust space, an inclined plate which is disposed on the side radially outward from the downstream side end plate in a region on a side opposite to the exhaust port on the basis of the axis, and gradually widens to an axially upstream side toward the radially outer side to define a part of the edge on the radially outer side of the exhaust space, and a side peripheral plate connected to the downstream side end plate and the inclined plate, and widens in the circumferential direction about the axis to define another part of the edge on the radially outer side of the exhaust space, in the inclined plate, an edge on the axially upstream side at a position diametrically opposite to the exhaust port on the basis of the axis is located on the axially upstream side, on the basis of a virtual plane which widens from an end on the radially outer side of the outer diffuser and is parallel to the downstream side end plate, and an angle of an inclined inner surface defining the exhaust space by the inclined plate with respect to a tangential line at the end on the radially outer side of the inner peripheral surface of the outer diffuser, which is an upstream side angle on the axially upstream side on the basis of the tangential line in the exhaust space, is greater than an angle of the inclined inner surface with respect to the tangential line, which is a downstream side angle on the axially downstream side on the basis of the tangential line in the exhaust space.

2. The exhaust casing according to claim 1, wherein the upstream side angle is 100° or more.

3. The exhaust casing according to claim 1, wherein the edge on the axially upstream side of the inclined plate is gradually displaced to the axially downstream side from the diametrically opposite position toward the exhaust port in the circumferential direction with respect to the axis, and an axial length of the inclined plate is gradually shortened from the diametrically opposite position toward the exhaust port in the circumferential direction.

4. The exhaust casing according to claim 1, wherein the inclined plate does not exist on a side of the exhaust port with respect to the axis.

5. The exhaust casing according to claim 1, Wherein the outer casing has a downstream side connection plate which connects the edge on the radially outer side of the downstream side end plate and the edge on the axially downstream side of the inclined plate, and the downstream side connection plate has a curved surface which is gradually bent to the axially upstream side from the downstream side inner surface defining the exhaust space by the downstream side end plate toward the radially outer side, and smoothly connects the downstream side inner surface and the inclined inner surface of the inclined plate.

6. The exhaust casing according to claim 1, wherein the outer casing has an upstream side end plate which faces the downstream side end plate in the axial direction to define the edge on the axially upstream side of the exhaust space, and the edge on the axially upstream side at the diametrically opposite position of the inclined plate is connected to the edge on the radially outer side of the upstream side end plate.

7. The exhaust casing according to claim 1, wherein the outer casing has an upstream side end plate which faces the downstream side end plate in the axial direction to define the edge on the axially upstream side of the exhaust space, and an upstream side connection plate Which connects the edge on the axially upstream side of the inclined plate and the edge on the radially outer side of the upstream side end plate, and the upstream side connection plate has a curved surface which is gradually bent to the radially inner side from the inclined inner surface of the inclined plate toward the axially upstream side, and smoothly connects the inclined inner surface and the upstream side inner surface defining the exhaust space by the upstream side end plate.

8. A steam turbine comprising:

the exhaust casing according to claim 1;

the steam turbine rotor;

a cylindrical inner casing disposed on an outer peripheral side of the steam turbine rotor; and a stator blade row disposed on an inner peripheral side of the inner casing, and having an end on the radially outer side attached to the inner casing.

* * * * *